US011455947B2

(12) United States Patent
Xuan et al.

(10) Patent No.: US 11,455,947 B2
(45) Date of Patent: Sep. 27, 2022

(54) PIXEL CIRCUIT, DRIVING METHOD THEREOF AND DISPLAY DEVICE

(71) Applicant: BOE TECHNOLOGY GROUP CO., LTD., Beijing (CN)

(72) Inventors: Minghua Xuan, Beijing (CN); Qi Qi, Beijing (CN); Jing Liu, Beijing (CN)

(73) Assignee: BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/265,246

(22) PCT Filed: Mar. 12, 2020

(86) PCT No.: PCT/CN2020/078982
§ 371 (c)(1),
(2) Date: Feb. 2, 2021

(87) PCT Pub. No.: WO2021/179247
PCT Pub. Date: Sep. 16, 2021

(65) Prior Publication Data

US 2022/0114948 A1 Apr. 14, 2022

(51) Int. Cl.
*G09G 3/32* (2016.01)
*G09G 3/20* (2006.01)

(52) U.S. Cl.
CPC ..... *G09G 3/32* (2013.01); *G09G 3/2011* (2013.01); *G09G 3/2014* (2013.01); *G09G 2310/061* (2013.01); *G09G 2310/08* (2013.01); *G09G 2320/066* (2013.01)

(58) Field of Classification Search
CPC ..... G09G 3/2007–2018; G09G 3/32–3291; G09G 2300/0809–0819; G09G 2300/0852; G09G 2300/0861; G09G 2300/0866; G09G 2310/06–063; G09G 2310/067; G09G 2310/08; G09G 2320/0233; G09G 2320/0242; G09G 2320/045; G09G 2320/0626–0666
See application file for complete search history.

(56) References Cited

U.S. PATENT DOCUMENTS

| | | | | |
|---|---|---|---|---|
| 9,779,657 | B2 * | 10/2017 | Kim | G09G 3/3233 |
| 2018/0061318 | A1 * | 3/2018 | Yin | G09G 3/3233 |
| 2020/0111404 | A1 * | 4/2020 | Kim | G09G 3/32 |
| 2020/0211452 | A1 * | 7/2020 | Lee | G09G 3/3291 |

* cited by examiner

*Primary Examiner* — Nathan Danielsen
(74) *Attorney, Agent, or Firm* — Houtteman Law LLC

(57) ABSTRACT

The present disclosure provides a pixel circuit including: a first resetting sub-circuit for writing a reference voltage and an initialization voltage to a first node and a second node, respectively; a first data writing sub-circuit for writing a first data voltage to a second node; a first output control sub-circuit for supplying a voltage at the first node to the switch sub-circuit; a charging and discharging sub-circuit for performing charge processing or discharge processing on the first node in response to control of the first data voltage; a switch sub-circuit coupled to the signal supply terminal and an element to be driven for controlling electrical coupling and decoupling between the signal supply terminal and the element to be driven under control of the voltage at the first node. The present disclosure also provides a driving method of the pixel circuit and a display device.

20 Claims, 6 Drawing Sheets

PIXEL CIRCUIT, DRIVING METHOD THEREOF AND DISPLAY DEVICE

TECHNICAL FIELD

The present disclosure relates to the field of display technology, and in particular, to a pixel circuit, a driving method thereof, and a display device.

BACKGROUND

Micro Light Emitting Diode (Micro-LED) technology is a technology in which an array of Micro-sized LEDs is integrated on one chip with high density to realize thin-filming, microminiaturization and matrixing of the LEDs, an interval between pixels can reach micron level, and each pixel can be addressed and emit light independently. Micro-LED display panels have been gradually developed toward display panels to be used in consumer terminals due to their characteristics of low driving voltage, long service life, wide temperature resistance, and the like.

SUMMARY

Embodiments of the present disclosure provide a pixel circuit, a driving method thereof and a display device, which can improve a display effect of a display device.

In a first aspect, an embodiment of the present disclosure provides a pixel circuit, including: a first resetting sub-circuit, a first data writing sub-circuit, a charging and discharging sub-circuit, a first output control sub-circuit and a switch sub-circuit, wherein the first resetting sub-circuit, the charging and discharging sub-circuit and the first output control sub-circuit are coupled to a first node, and the first resetting sub-circuit, the first data writing sub-circuit and the charging and discharging sub-circuit are coupled to a second node;

the first resetting sub-circuit is configured to write a reference voltage and an initialization voltage to the first node and the second node, respectively, in response to control of a signal of a reset signal line;

the first data writing sub-circuit is configured to write a first data voltage to the second node in response to control of a signal of a gate line;

the first output control sub-circuit is configured to form an electrical path between the charging and discharging sub-circuit and a charging and discharging terminal, and provide a voltage at the first node to the switch sub-circuit in response to control of a signal of a control signal line;

the charging and discharging sub-circuit is configured to charge or discharge the first node in response to control of the first data voltage;

the switch sub-circuit is coupled to a signal supply terminal and an element to be driven, and is configured to control, in response to control of the voltage at the first node provided by the first output control sub-circuit, coupling and decoupling between the signal supply terminal and the element to be driven.

In some implementations, the first resetting sub-circuit includes: a first transistor and a second transistor;

a control electrode of the first transistor is coupled to the reset signal line, a first electrode of the first transistor is coupled to a reference voltage terminal, and a second electrode of the first transistor is coupled to the first node;

a control electrode of the second transistor is coupled to the reset signal line, a first electrode of the second transistor is coupled to an initialization voltage terminal, and a second electrode of the second transistor is coupled to the second node.

In some implementations, the first data writing sub-circuit includes: a third transistor;

a control electrode of the third transistor is coupled to the gate line, a first electrode of the third transistor is coupled to a first data line, and a second electrode of the third transistor is coupled to the second node.

In some implementations, the first output control sub-circuit includes: a fourth transistor and a fifth transistor;

a control electrode of the fourth transistor is coupled to the control signal line, a first electrode of the fourth transistor is coupled to the charging and discharging sub-circuit, and a second electrode of the fourth transistor is coupled to the charging and discharging terminal; and a control electrode of the fifth transistor is coupled to the control signal line, a first electrode of the fifth transistor is coupled to the first node, and a second electrode of the fifth transistor is coupled to the switch sub-circuit.

In some implementations, the charging and discharging sub-circuit includes: a sixth transistor and a first capacitor;

a control electrode of the sixth transistor is coupled to the second node, a first electrode of the sixth transistor is coupled to the first node, and a second electrode of the sixth transistor is coupled to the first output control sub-circuit;

a first terminal of the first capacitor is coupled to the first node, and a second terminal of the first capacitor is coupled to a first constant voltage terminal.

In some implementations, the switch sub-circuit includes: a seventh transistor;

a control electrode of the seventh transistor is coupled to the first output control sub-circuit, a first electrode of the seventh transistor is coupled to the signal supply terminal, and a second electrode of the seventh transistor is coupled to the element to be driven.

In some implementations, the pixel circuit further includes: a second capacitor;

a first terminal of the second capacitor is coupled to the second node, and a second terminal of the second capacitor is coupled to a second constant voltage terminal.

In some implementations, the signal supply terminal is coupled to a first operation voltage terminal, the first operation voltage terminal providing a first operation voltage to the switch sub-circuit via the signal supply terminal.

In some implementations, the pixel circuit further includes: a driving current supply circuit, wherein the driving current supply circuit is coupled to the signal supply terminal, and the driving current supply circuit is configured to provide a driving current to the switch sub-circuit through the signal supply terminal.

In some implementations, the driving current supply circuit includes: a second resetting sub-circuit, a second data writing sub-circuit, a threshold compensation sub-circuit, a second output control sub-circuit, and a driving transistor, wherein a second electrode of the driving transistor, the threshold compensation sub-circuit, and the second output control sub-circuit are coupled to a fourth node, a control electrode of the driving transistor, the threshold compensation sub-circuit, and the second resetting sub-circuit are coupled to a fifth node, and a first electrode of the driving transistor, the second data writing sub-circuit, and the second output control sub-circuit are coupled to a sixth node; and the second resetting sub-circuit is configured to write the reference voltage to the fifth node in response to control of the signal of the reset signal line;

the second data writing sub-circuit is configured to write a second data voltage to the sixth node in response to control of the signal of the gate line;

the threshold compensation sub-circuit is configured to compensate for a threshold voltage of the driving transistor in response to control of the signal of the gate line;

the second output control sub-circuit is configured to write the first operation voltage to the sixth node and supply the driving current output by the driving transistor to the signal supply terminal in response to control of the signal of the control signal line;

the driving transistor is configured to output a corresponding driving current under control of a voltage at the fifth node and a voltage at the sixth node.

In some implementations, the second resetting sub-circuit includes: an eighth transistor, and a control electrode of the eighth transistor is coupled to the reset signal line, a first electrode of the eighth transistor is coupled to the reference voltage terminal, and a second electrode of the eighth transistor is coupled to the fifth node.

In some implementations, the second data writing sub-circuit includes: a ninth transistor, and a control electrode of the ninth transistor is coupled to the gate line, a first electrode of the ninth transistor is coupled to a second data line, and a second electrode of the ninth transistor is coupled to the sixth node.

In some implementations, the threshold compensation sub-circuit includes: a tenth transistor, and a control electrode of the tenth transistor is coupled to the gate line, a first electrode of the tenth transistor is coupled to the fourth node, and a second electrode of the tenth transistor is coupled to the fifth node.

In some implementations, the second output control sub-circuit includes: an eleventh transistor and a twelfth transistor, and a control electrode of the eleventh transistor is coupled to the control signal line, a first electrode of the eleventh transistor is coupled to the first operation voltage terminal, and a second electrode of the eleventh transistor is coupled to the sixth node;

a control electrode of the twelfth transistor is coupled to the control signal line, a first electrode of the twelfth transistor is coupled to the fourth node, and a second electrode of the twelfth transistor is coupled to the signal supply terminal.

In some implementations, the pixel circuit further includes: a third capacitor, and a first terminal of the third capacitor is coupled to the fifth node, and a second terminal of the third capacitor is coupled to a third constant voltage terminal.

In some implementations, all the transistors in the pixel circuit are N-type transistors; or all the transistors in the pixel circuit are P-type transistors.

In a second aspect, an embodiment of the present disclosure provides a display device, including: a display substrate including a plurality of sub-pixels, at least one of the sub-pixels is provided with the pixel circuit in the first aspect and an element to be driven, the pixel circuit being configured to provide a driving signal to the element to be driven.

In some implementations, the element to be driven includes an LED or a Micro-LED.

In a third aspect, an embodiment of the present disclosure provides a driving method of a pixel circuit, for driving the pixel circuit in the first aspect, the driving method including:

applying a reset signal to the reset signal line, a reference voltage to the reference voltage terminal, and an initialization voltage to the initialization voltage terminal, so that the first resetting sub-circuit writes the reference voltage and the initialization voltage to the first node and the second node, respectively, in response to control of the reset signal;

applying a gate scan signal to the gate line, applying a first data voltage to the first data line, so that the first data writing sub-circuit writes the first data voltage to the second node in response to control of the gate scan signal; and applying a control signal to the control signal line so that the first output control sub-circuit forms an electrical path between the charging and discharging sub-circuit and the charging and discharging terminal in response to control of the control signal, and provides the voltage at the first node to the switch sub-circuit, the charging and discharging sub-circuit charges or discharges the first node in response to control of the first data voltage, and the switch sub-circuit controls coupling and decoupling between the signal supply terminal and the element to be driven in response to control of the voltage at the first node.

In some implementations, the pixel circuit includes a driving current supply circuit including: a second resetting sub-circuit, a second data writing sub-circuit, a threshold compensation sub-circuit, a second output control sub-circuit, and a driving transistor; and the second resetting sub-circuit writes the reference voltage to the fifth node in response to control of the reset signal when the reset signal is applied to the reset signal line and the reference voltage is applied to the reference voltage terminal;

while applying the gate scan signal to the gate line, applying a second data voltage to the second data line to cause the second data writing sub-circuit to write the second data voltage to the sixth node, the threshold compensation sub-circuit compensates for the threshold voltage of the driving transistor in response to control of the gate line;

while applying the control signal to the control signal line, applying the first operation voltage to the first operation voltage terminal, so that the second output control sub-circuit writes the first operation voltage to the sixth node in response to control of the control signal, and supplies the driving current output by the driving transistor to the signal supply terminal.

DESCRIPTION OF EMBODIMENTS

In order to make those ordinary skilled in the art better understand technical solutions of the present invention, a pixel circuit, a driving method thereof, and a display device provided by the present disclosure are described in detail below with reference to the accompanying drawings.

In the embodiments of the present disclosure, the element to be driven may be a light emitting element, and the light emitting element may be a light emitting device driven by current/voltage, including a light emitting diode (LED) or a Micro-LED, and in the following embodiments, the element to be driven is the Micro-LED, and a size of the Micro-LED is in the micrometer (μm) level.

In addition, each of transistors involved in the embodiments of the present disclosure may be independently selected from one of a polycrystalline silicon thin film transistor, an amorphous silicon thin film transistor, an oxide thin film transistor, and an organic thin film transistor. A "control electrode" involved in the present disclosure specifically refers to a gate electrode of a transistor, a "first electrode" specifically refers to a source electrode of the transistor, and a corresponding "second electrode" specifically refers to a drain electrode of the transistor. Certainly, those ordinary skilled in the art should understand that the "first electrode" and the "second electrode" are interchangeable.

In addition, the transistors may be divided into N-type transistors and P-type transistors, and each of the transistors in the present disclosure may be independently selected from an N-type transistor or a P-type transistor; in the following embodiments, all transistors in a pixel unit are N-type transistors, which may be fabricated simultaneously by a same fabrication process. Correspondingly, a first operation voltage is a high-level operation voltage Vdd, and a second operation voltage is a low-level operation voltage Vss; in addition, it is assumed that a first constant voltage terminal GND is grounded, a second constant voltage terminal provides the low-level operation voltage Vss, and a third constant voltage terminal provides the high-level operation voltage Vdd. The above settings of the type of the transistor, the operation voltage, and the constant voltage terminal are only exemplary, and do not limit the technical solutions of the present disclosure.

Figure 1:
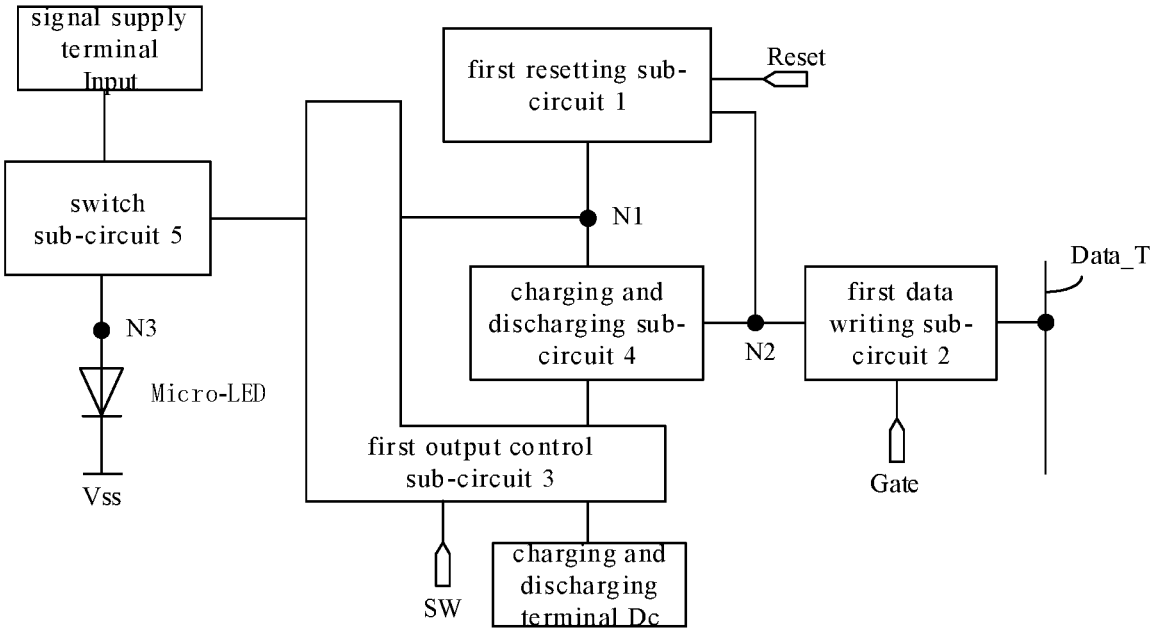
FIG. 1 is a schematic circuit diagram of a pixel circuit according to an embodiment of the present disclosure.

FIG. 1 is a schematic circuit diagram of a pixel circuit according to an embodiment of the present disclosure, and as shown in FIG. 1, the pixel circuit includes: a first resetting sub-circuit 1, a first data writing sub-circuit 2, a charging and discharging sub-circuit 3, a first output control sub-circuit 4 and a switch sub-circuit 5. The first resetting sub-circuit 1, the charging and discharging sub-circuit 3 and the first output control sub-circuit 4 are coupled to a first node N1, the first resetting sub-circuit 1, the first data writing sub-circuit 2 and the charging and discharging sub-circuit 3 are coupled to a second node N2, an anode of a Micro-LED to be driven and the switch sub-circuit 5 are coupled to a third node N3, and a cathode of the Micro-LED is coupled to a second operation voltage terminal.

The first resetting sub-circuit 1 is configured to write a reference voltage and an initialization voltage to the first node N1 and the second node N2, respectively, in response to control of a signal of a reset signal line Reset.

The first data writing sub-circuit 2 is configured to write a first data voltage to the second node N2 in response to control of a signal of a gate line Gate.

The first output control sub-circuit 4 is configured to form an electrical path between the charging and discharging sub-circuit 3 and a charging and discharging terminal Dc in response to control of a signal of a control signal line SW, and to supply a voltage at the first node N1 to the switch sub-circuit 5.

The charging and discharging sub-circuit 3 is configured to perform a charging process or a discharging process on the first node N1 in response to control of the first data voltage.

The switch sub-circuit 5 is coupled to a signal supply terminal Input and the element (Micro-LED) to be driven, and is configured to control electrical coupling or decoupling between the signal supply terminal Input and the element (Micro-LED) to be driven in response to control of the voltage at the first node N1 provided by the first output control sub-circuit 4. When the signal supply terminal Input is electrically coupled to the element (Micro-LED) to be driven, a signal supplied by the signal supply terminal Input can be written into the element (Micro-LED) to be driven, and the element (Micro-LED) to be driven can be driven to operate; when the signal supply terminal Input and the element (Micro-LED) to be driven are electrically decoupled from each other, the signal supplied by the signal supply terminal Input cannot be written into the element (Micro-LED) to be driven, and the element (Micro-LED) to be driven cannot operate.

In the embodiment of the present disclosure, a charging/discharging speed of the charging and discharging sub-circuit 3 on the first node N1, that is, the charging/discharging speed of the first node N1 (a voltage change rate of the first node N1) can be controlled by the first data voltage, and the switch sub-circuit 5 controls the electrical coupling or decoupling between the signal supply terminal Input and the element (Micro-LED) to be driven based on the voltage at the first node N1.

Specifically, when the transistor in the switch sub-circuit 5 is an N-type transistor, the voltage provided by the charging and discharging terminal Dc (e.g., the ground voltage provided by the charging and discharging terminal Dc) needs to be designed to be less than the reference voltage, and the reference voltage needs to be sufficient to turn on the transistor in the switch sub-circuit 5, in such case, the charging and discharging sub-circuit 3 performs a discharging process on the first node N1, so that the voltage at the first node N1 decreases, and the N-type transistor in the switch sub-circuit 5 is switched from being turned on to being turned off. When the transistor in the switch sub-circuit 5 is a P-type transistor, the voltage provided by the charging and discharging terminal Dc (e.g., the high-level operation voltage Vdd provided by the charging and discharging terminal Dc) needs to be designed to be greater than the reference voltage, and the reference voltage needs to be sufficient to turn on the transistor in the switch sub-circuit 5, in such case, the charging and discharging sub-circuit 3 performs a charging process on the first node N1, so that the voltage at the first node N1 rises, and the P-type transistor in the switch sub-circuit 5 is switched from being turned on to being turned off.

As an example, when the transistor in the switch sub-circuit 5 is an N-type transistor, if a voltage provided by the first output control sub-circuit 4 to the switch sub-circuit 5 is greater than a preset threshold, the switch sub-circuit 5 is in an "on" state, and the signal supply terminal Input is electrically coupled to the element (Micro-LED) to be driven; if the voltage provided by the first output control sub-circuit 4 to the switch sub-circuit 5 is less than or equal to the preset threshold, the switch sub-circuit 5 is in an "off" state, and the signal supply terminal Input and the element (Micro-LED) to be driven are electrically decoupled from each other.

As another example, when the transistor in the switch sub-circuit 5 is a P-type transistor, if the voltage provided by the first output control sub-circuit 4 to the switch sub-circuit 5 is less than the preset threshold, the switch sub-circuit 5 is in an "on" state, and the signal supply terminal Input is electrically coupled to the element (Micro-LED) to be driven; if the voltage provided by the first output control sub-circuit 4 to the switch sub-circuit 5 is greater than or equal to the preset threshold, the switch sub-circuit 5 is in an "off" state, and the signal supply terminal Input and the element (Micro-LED) to be driven are electrically decoupled from each other.

The charging/discharging speed of the first node N1 is controlled by controlling the first data voltage, so that a time duration that the voltage at the first node N1 is charged/discharged to the preset threshold from the reference voltage can be controlled, and further a time duration that the switch sub-circuit 5 is in the "on" state is controlled, that is, an operation time duration of the element (Micro-LED) to be driven is controlled.

In the embodiment of the present disclosure, the signal supply terminal Input may be used to provide a constant voltage signal or a constant current signal within a frame. When the signal supply terminal Input provides a constant voltage signal, taking the constant voltage signal being the first operation voltage Vdd as an example, when the voltage Vdd and the voltage Vss are respectively loaded at two terminals of the LED, a current density of a current flowing through the element (Micro-LED) to be driven is fixed (that is, the current flowing through the element (Micro-LED) to be driven is fixed in magnitude); when the signal supply terminal Input provides a constant current signal, the current flowing through the element (Micro-LED) to be driven is fixed in magnitude. Because the magnitude of the current flowing through the element (Micro-LED) to be driven and the operation time duration of the element (Micro-LED) to be driven in a period (for example, in a frame) affect the effective light emitting brightness of the element (Micro-LED) to be driven in the period, and thus the effective light emitting brightness of the element (Micro-LED) to be driven in the period can be controlled by controlling the voltage/current signal provided by the control signal supply terminal Input and the first data voltage provided by a first data line Data_T, to achieve a purpose of adjusting a display gray scale.

Figure 2:
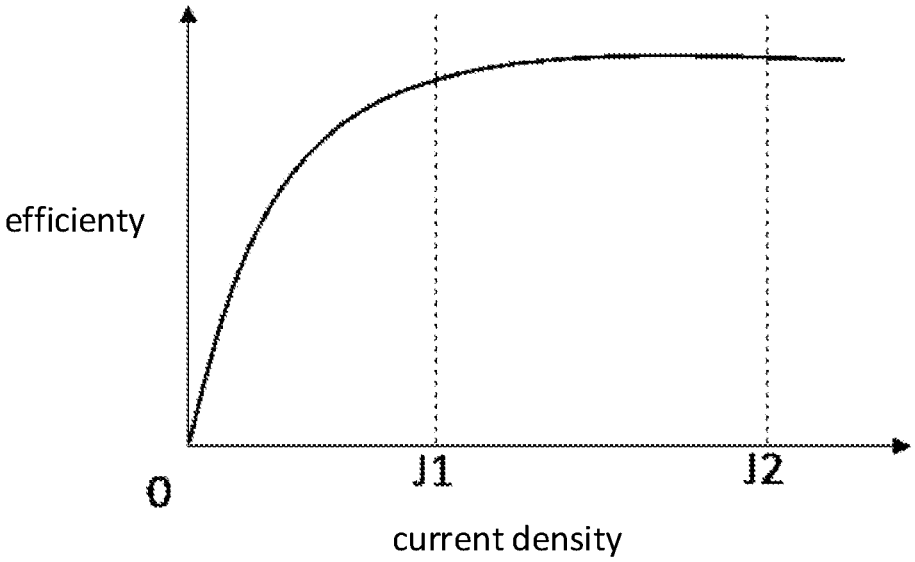
FIG. 2 is a schematic diagram of device characteristics of an element to be driven in an embodiment of the present disclosure.

FIG. 2 is a schematic diagram illustrating device characteristics of an element to be driven according to an embodiment of the present disclosure, and as shown in FIG. 2, the light emitting efficiency of the Micro-LED to be driven gradually increases with an increase in current density, and stabilizes at a maximum value when the current density is between J1 and J2. Thus, in consideration of saving display power consumption, the element (Micro-LED) to be driven is generally required to operate in a state where the current density is between J1 and J2. However, the current density being between J1 and J2 is very limited for many types of Micro-LEDs as elements to be driven, and if different gray levels are obtained by adjusting only the magnitude of current, the resulting display contrast may be very low. For this reason, in the embodiment of the present disclosure, the current density during operation of the element (Micro-LED) to be driven can be set within a stable range (between J1 and J2), and the time duration of the "on" state of the switch sub-circuit 5 in each period is adjusted by the first data voltage to control the display gray scale, so as to achieve high contrast of the display device.

According to the technical solution of the present disclosure, high contrast is achieved on the premise that the current density of the element to be driven is in the stable range, the problems of color cast, efficiency reduction and the like caused by the fact that the current density of the element to be driven is out of the stable range can be avoided, and high contrast required by a display product can be achieved. Therefore, the embodiment of the present disclosure can reduce display defects caused by the electrical characteristics of the elements to be driven easily drifting with the current density, and improve the display performance of the related display products.

Figure 3:
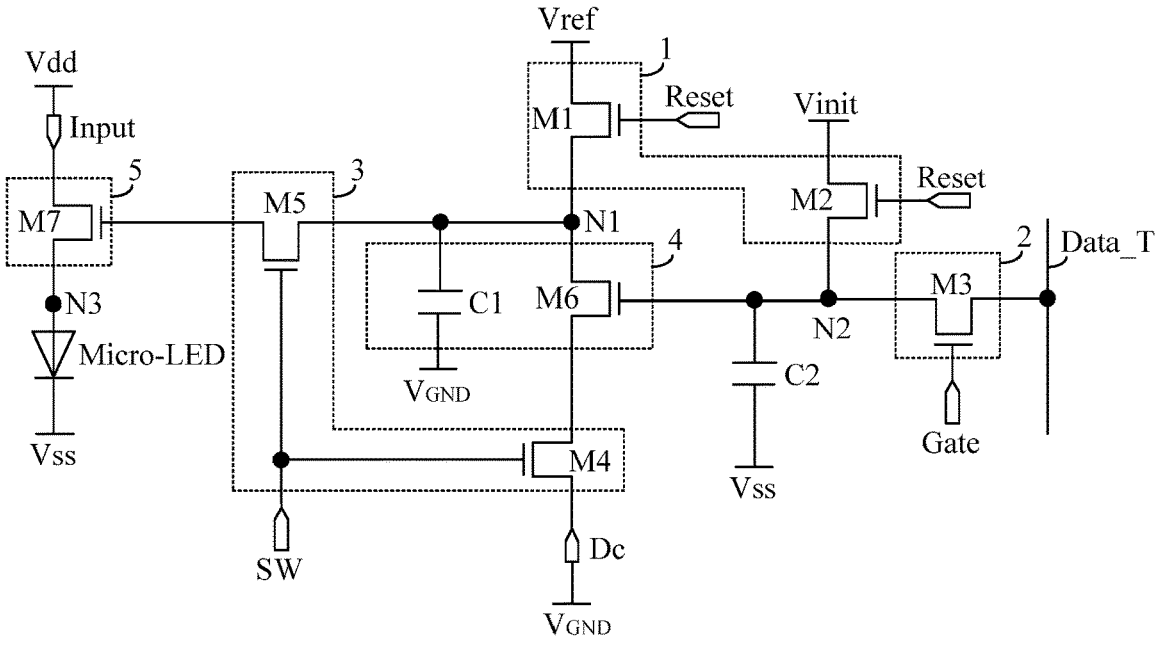
FIG. 3 is a schematic circuit diagram of another pixel circuit according to an embodiment of the present disclosure.

FIG. 3 is a schematic circuit diagram of another pixel circuit provided in an embodiment of the present disclosure, and as shown in FIG. 3, the pixel circuit is an embodiment of the pixel circuit shown in FIG. 1, where the signal supply terminal Input is coupled to the first operation voltage terminal, and the first operation voltage terminal provides the first operation voltage Vdd for the switch sub-circuit 5 through the signal supply terminal Input.

In some implementations, the first resetting sub-circuit 1 includes: a first transistor M1 and a second transistor M2; a control electrode of the first transistor M1 is coupled to the reset signal line Reset, a first electrode of the first transistor M1 is coupled to the reference voltage terminal, and a second electrode of the first transistor M1 is coupled to the first node N1; a control electrode of the second transistor M2 is coupled to the reset signal line Reset, a first electrode of the second transistor M2 is coupled to an initialization voltage terminal, and a second electrode of the second transistor M2 is coupled to the second node N2.

In some implementations, the first data writing sub-circuit 2 includes: a third transistor M3; a control electrode of the third transistor M3 is coupled to the gate line Gate, a first electrode of the third transistor M3 is coupled to the first data line Data_T, and a second electrode of the third transistor M3 is coupled to the second node N2.

In some implementations, the first output control sub-circuit 4 includes: a fourth transistor M4 and a fifth transistor M5; a control electrode of the fourth transistor M4 is coupled to a control signal line SW, a first electrode of the fourth transistor M4 is coupled to the charging and discharging sub-circuit 3, and a second electrode of the fourth transistor M4 is coupled to the charging and discharging terminal Dc; a control electrode of the fifth transistor M5 is coupled to the control signal line SW, a first electrode of the fifth transistor M5 is coupled to the first node N1, and a second electrode of the fifth transistor M5 is coupled to the switch sub-circuit 5.

In some implementations, the charging and discharging sub-circuit 3 includes: a sixth transistor M6 and a first capacitor C1; a control electrode of the sixth transistor M6 is coupled to the second node N2, a first electrode of the sixth transistor M6 is coupled to the first node N1, and a second electrode of the sixth transistor M6 is coupled to the first output control sub-circuit 4; a first terminal of the first capacitor C1 is coupled to the first node N1, and a second terminal of the first capacitor C1 is coupled to the first constant voltage terminal.

In some implementations, the switch sub-circuit 5 includes: a seventh transistor M7; a control electrode of the seventh transistor M7 is coupled to the first output control sub-circuit 4, a first electrode of the seventh transistor M7 is coupled to the signal supply terminal Input, and a second electrode of the seventh transistor M7 is coupled to the element (Micro-LED) to be driven.

In some implementations, the pixel circuit further includes: a second capacitance C2; a first terminal of the second capacitor C2 is coupled to the second node N2, and a second terminal of the second capacitor C2 is coupled to a second constant voltage terminal. The second capacitor C2 is used to maintain the voltage at the second node N2 stable, which is not a necessary result in the pixel circuit.

Assuming that the first transistor M1 to the seventh transistor M7 are all N-type transistors, the charging and discharging sub-circuit 3 is configured to discharge the first node N1 to the ground voltage provided by the charging and discharging terminal Dc.

Figure 4:
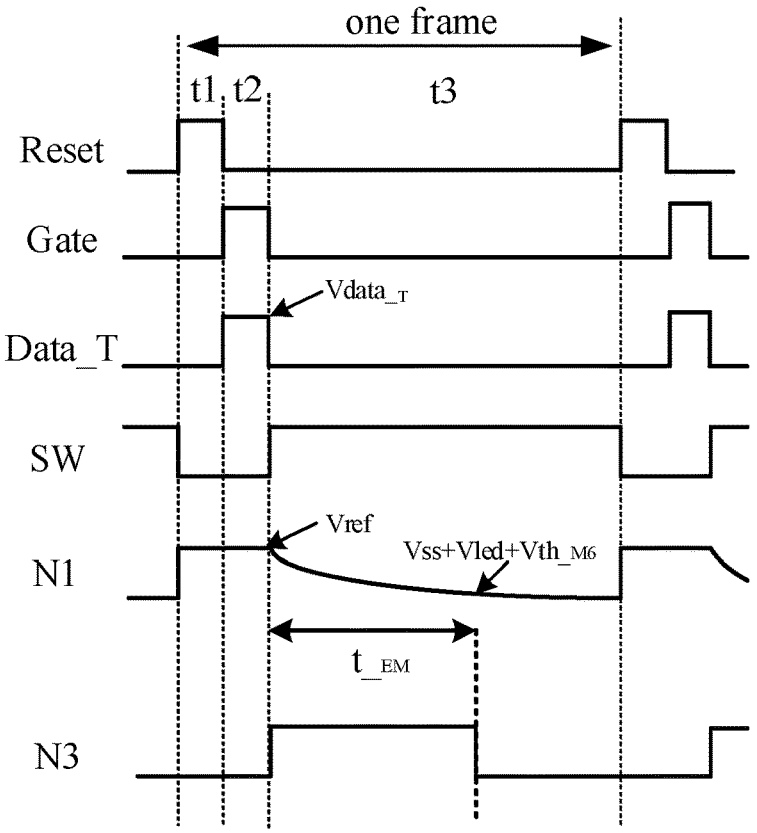
FIG. 4 is a timing diagram illustrating an operation of the pixel circuit shown in FIG. 3.

An operation of the pixel circuit shown in FIG. 3 will be described in detail below with reference to the accompanying drawing. FIG. 4 is a timing diagram illustrating the operation of the pixel circuit shown in FIG. 3, and the operation of the pixel circuit can be divided into three stages including a first state t1, a second stage t2, and a third stage t3.

In the first stage t1, the reset signal provided by the reset signal line Reset is at a high level, a gate scan signal provided by the gate line Gate is at a low level, and the control signal provided by the control signal line SW is at a low level. In such case, the first transistor M1 and the second transistor M2 are turned on, and the third transistor M3 to the seventh transistor M7 are turned off. The reference voltage Vref provided by the reference voltage terminal is written to the first node N1 through the first transistor M1, and the initialization voltage Vinit provided by the initialization voltage terminal is written to the second node N2 through the second transistor M2. Since the seventh transistor M7 is turned off, the first operation voltage terminal is electrically decoupled from the third node N3.

In the second stage t2, the reset signal provided by the reset signal line Reset is at a low level, the gate scan signal provided by the gate line Gate is at a high level, and the control signal provided by the control signal line SW is at a low level. In such case, the third transistor M3 is turned on, and the first transistor M1, the second transistor M2, and the fourth to seventh transistors M4 to M7 are turned off. The first data voltage supplied from the first data line Data_T is written to the second node N2 through the third transistor M3. Since the seventh transistor M7 is turned off, the first operation voltage terminal is electrically decoupled from the third node N3.

In the third stage t3, the reset signal provided by the reset signal line Reset is at a low level, the gate scan signal provided by the gate line Gate is at a low level, and the control signal provided by the control signal line SW is at a high level. In such case, the fourth transistor M4 to the sixth transistor M6 are turned on, the first transistor M1 to the third transistor M3 are turned off, and the seventh transistor M7 is turned on first and then turned off.

The second capacitor C2 can maintain the voltage of the second node N2 stable at the first data voltage in the third stage t3.

When the fourth transistor M4 is turned on, the second electrode of the sixth transistor M6 is coupled to the charging and discharging terminal Dc, and the sixth transistor M6 is controlled by the voltage at the second node N2 to operate in a saturation state, it can be obtained according to the saturation current formula that:

$$\begin{aligned} I_{_M6} &= K_{_M6} * (Vgs_{_M6} - Vth_{_M6})^2 \\ &= K_{_M6} * (Vdata_{_T} - V_{GND} - Vth_{_M6})^2 \end{aligned},$$

where $I_{_M6}$ is a current outputted by the sixth transistor M6 in the saturation state, $Vgs_{_M6}$ is a gate-source voltage of the sixth transistor M6, $Vth_{_M6}$ is a threshold voltage of the sixth transistor M6, $Vdata_{_T}$ is the first data voltage, $V_{GND}$ is the ground voltage (approximately OV), $K_{_M6}$ is a constant and is determined by the electric characteristics of the sixth transistor M6.

In such case, an equivalent resistance of the sixth transistor M6 is:

$$R_{_M6} = \frac{U}{I_{_M6}} = \frac{Vref - V_{GND}}{K_{_M6} * (Vdata_{_T} - V_{GND} - Vth_{_M6})^2},$$

where Vref is the reference voltage; in a case where the Vref, $K_{_M6}$, $V_{GND}$ and $Vth_{_M6}$ are fixed, a magnitude of the equivalent resistance $R_{_M6}$ of the sixth transistor M6 is determined by only the first data voltage $Vdata_{_T}$.

During the voltage at the first node N1 changes from the reference voltage to the ground voltage due to discharging, a total discharge time $t=R_{_M6}\times C1'$, where Cr represents the capacitance of the first capacitor C1. A magnitude of the total discharge time also reflects an average discharge speed of the first node N1, where the smaller the discharge time is, the faster the average discharge speed is. In a case where the capacitance C1' of the first capacitor C1 is fixed, the total discharge time t is determined by the magnitude of the equivalent resistance $R_{_M6}$ of the sixth transistor M6, and since the magnitude of the equivalent resistance $R_{_M6}$ of the sixth transistor M6 is determined by only the first data voltage $Vdata_{_T}$, the total discharge time and the average discharge speed are determined by the first data voltage $Vdata_{_T}$.

During the discharging, in the process of discharging the voltage at the first node N1 from Vref to $Vss+V_{_led}+Vth_{_M7}$, the seventh transistor M7 is always turned on, and the voltage at the third node N3 is at a high level, where $V_{_led}$ is a voltage difference between an anode and a cathode of the element to be driven when the element to be driven is in the operation state, $Vth_{_M7}$ is the threshold voltage of the seventh transistor M7. When the voltage at the first node N1 reaches $Vss+V_{_led}\pm Vth_{_M7}$, the seventh transistor M7 is switched from being turned on to being turned off (the preset threshold is $Vss+V_{_led}\pm Vth_{_M7}$). When the voltage at the first node N1 is less than $Vss+V_{_led}+Vth_{_M7}$, the seventh transistor M7 is always turned off, and the voltage at the third node N3 is at a low level.

A time duration $t_{_EM}$ that the voltage at the first node N1 is discharged from Vref to $Vss+V_{_led}+Vth_{_M7}$ is inversely related to the average discharge speed, that is, the faster the average discharge speed is, the shorter the time duration that the voltage at the first node N1 is discharged from Vref to $Vss+V_{_led}\pm Vth_{_M7}$ is. Therefore, by adjusting the first data voltage $Vdata_{_T}$, the time duration that the voltage at the first node N1 is discharged from Vref to $Vss+V_{_led}\pm Vth_{_M7}$ can be adjusted.

Therefore, in the embodiment of the present disclosure, the duration of the seventh transistor M7 being turned on can be adjusted by adjusting the magnitude of the first data voltage, so that the display gray scale can be adjusted.

It should be noted that, if the first transistor M1 to the seventh transistor M7 are all P-type transistors, the charging and discharging sub-circuit 3 is configured to charge the first node N1, and the charging and discharging terminal Dc provides a high-level operation voltage, which is not shown in the drawings. The operation process of the pixel circuit with all the transistors being P-type transistors is the same as that of the pixel circuit with all the transistors being N-type transistors, and is not described herein again.

Figure 5:
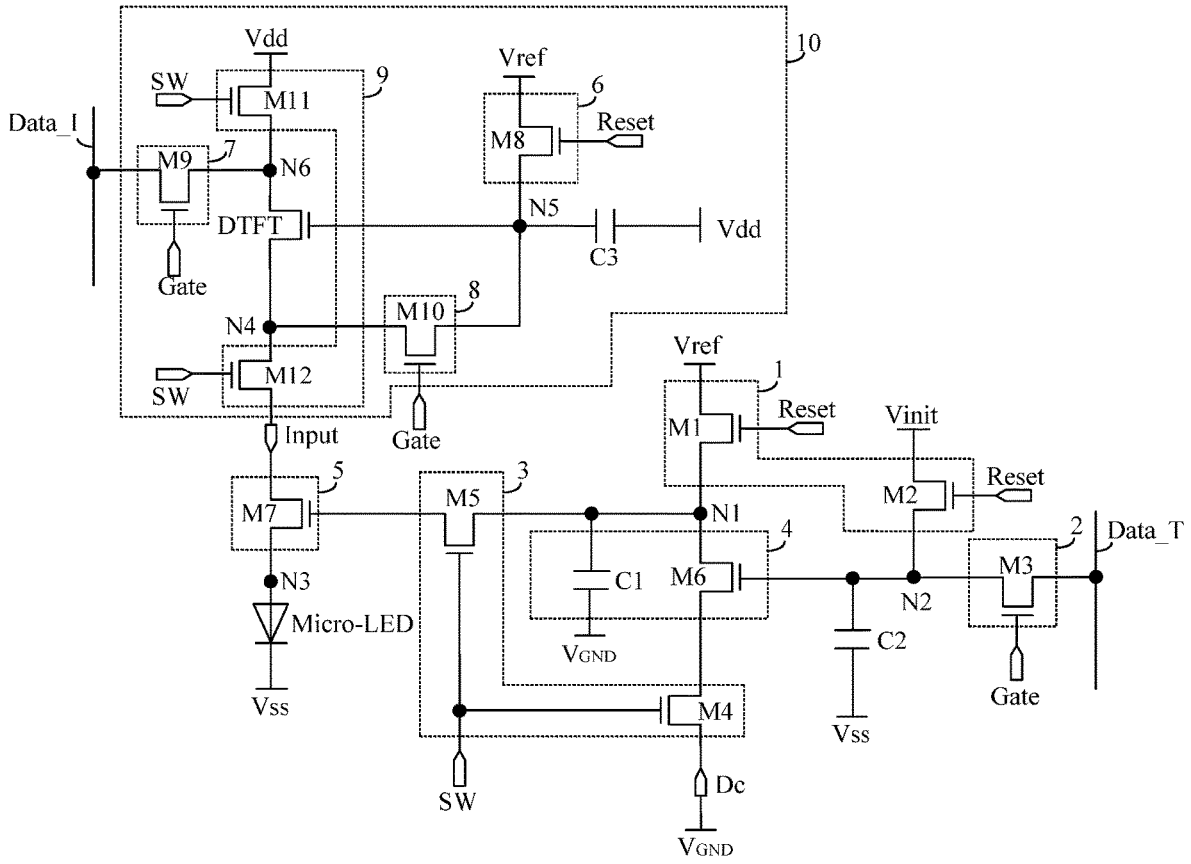
FIG. 5 is a schematic circuit diagram of yet another pixel circuit according to an embodiment of the present disclosure.

FIG. 5 is a schematic circuit diagram of another pixel circuit provided in an embodiment of the present disclosure, and as shown in FIG. 5, the difference between the pixel circuit shown in FIG. 5 and the pixel circuit provided in the foregoing embodiment is in that, the pixel circuit shown in FIG. 5 further includes: a driving current supply circuit 10, where the driving current supply circuit 10 is coupled to the signal supply terminal Input, and the driving current supply circuit 10 is configured to supply a driving current to the switch sub-circuit 5 through the signal supply terminal Input. Compared with the forgoing embodiment, in the present embodiment, the driving current supply circuit 10 can supply driving currents with different magnitudes to the signal supply terminal Input in different periods (for example, different frames), and the display contrast ratio can be effectively improved.

For the specific description of the first resetting sub-circuit 1, the first data writing sub-circuit 2, the charging and discharging sub-circuit 3, the first output control sub-circuit 4 and the switch sub-circuit 5 in the pixel circuit shown in FIG. 5, reference may be made to the corresponding contents in the foregoing embodiment, and details thereof are not repeated here. Only the driving current supply circuit in the present embodiment will be described in detail below.

In some implementations, the driving current supply circuit 10 includes: a second resetting sub-circuit 6, a second data writing sub-circuit 7, a threshold compensation sub-circuit 8, a second output control sub-circuit 9, and a driving transistor DTFT, a second electrode of the driving transistor DTFT, the threshold compensation sub-circuit 8, and the second output control sub-circuit 9 are coupled to a fourth node N4, a control electrode of the driving transistor DTFT, the threshold compensation sub-circuit 8 and the second resetting sub-circuit 6 are coupled to a fifth node N5, and a first electrode of the driving transistor DTFT, the second data writing sub-circuit 7 and the second output control sub-circuit 9 are coupled to a sixth node N6.

The second resetting sub-circuit 6 is configured to write the reference voltage to the fifth node N5 in response to control of the signal of the reset signal line Reset.

The second data writing sub-circuit 7 is configured to write the second data voltage to the sixth node N6 in response to control of the signal of the gate line Gate.

The threshold compensation sub-circuit 8 is configured to compensate for the threshold voltage of the driving transistor in response to control of the signal of the gate line Gate.

The second output control sub-circuit 9 is configured to write the first operation voltage to the sixth node N6 and supply the drive current output by the driving transistor DTFT to the signal supply terminal Input in response to control of the signal of the control signal line SW.

The driving transistor DTFT is configured to output a corresponding driving current under the control of the voltage at the fifth node N5 and the voltage at the sixth node N6.

In some implementations, the second resetting sub-circuit 6 includes an eighth transistor M8, a control electrode of the eighth transistor M8 is coupled to the reset signal line Reset, a first electrode of the eighth transistor M8 is coupled to the reference voltage terminal, and a second electrode of the eighth transistor M8 is coupled to the fifth node N5.

In some implementations, the second data writing sub-circuit 7 includes a ninth transistor M9, a control electrode of the ninth transistor M9 is coupled to the gate line Gate, a first electrode of the ninth transistor M9 is coupled to a second data line Data_I, and a second electrode of the ninth transistor M9 is coupled to the sixth node N6.

In some implementations, the threshold compensation sub-circuit 8 includes a tenth transistor M10, a control electrode of the tenth transistor M10 is coupled to the gate line Gate, a first electrode of the tenth transistor M10 is coupled to the fourth node N4, and a second electrode of the tenth transistor M10 is coupled to the fifth node N5.

In some implementations, the second output control sub-circuit 9 includes: an eleventh transistor M11 and a twelfth transistor M12, a control electrode of the eleventh transistor M11 is coupled to the control signal line SW, a first electrode of the eleventh transistor M11 is coupled to the first operation voltage terminal, and a second electrode of the eleventh transistor M11 is coupled to the sixth node N6; a control electrode of the twelfth transistor M12 is coupled to the control signal line SW, a first electrode of the twelfth transistor M12 is coupled to the fourth node N4, and a second electrode of the twelfth transistor M12 is coupled to the signal supply terminal Input.

In some implementations, the pixel circuit further includes a third capacitor C3; a first terminal of the third capacitor C3 is coupled to the fifth node N5, and a second terminal of the third capacitor C3 is coupled to a third constant voltage terminal. The third capacitor C3 is used to maintain a voltage at the fifth node N5 stable, which is not a necessary result in the pixel circuit.

It is assumed that the eighth transistor M8 through the twelfth transistor M12 are all N-type transistors, and the reference voltage is sufficient to turn on the driving transistor DTFT.

Figure 6:
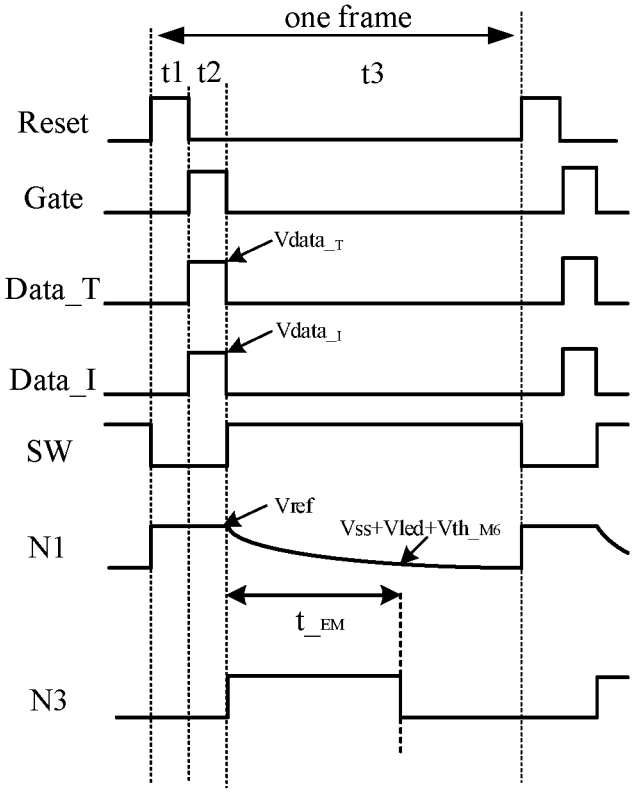
FIG. 6 is a timing diagram illustrating an operation of the pixel circuit shown in FIG. 5.

An operation of the pixel circuit shown in FIG. 5 will be described in detail below with reference to the accompanying drawing. FIG. 6 is a timing diagram illustrating an operation of the pixel circuit shown in FIG. 5, and as shown in FIG. 6, the operation of the pixel circuit can be divided into three stages including a first stage t1, a second stage t2 and a third stage t3.

In the first stage t1, the reset signal provided by the reset signal line Reset is at a high level, the gate scan signal provided by the gate line Gate is at a low level, and the control signal provided by the control signal line SW is at a low level. In such case, the first transistor M1, the second transistor M2, and the eighth transistor M8 are turned on, and the third transistor M3 to the seventh transistor M7, and the ninth transistor M9 to the twelfth transistor M12 are all turned off. The reference voltage Vref provided by the reference voltage terminal is written to the first node N1 through the first transistor M1, written to the fifth node N5 through the eighth transistor M8, and the initialization voltage Vinit provided by the initialization voltage terminal is written to the second node N2 through the second transistor M2. Since the eleventh transistor M11 and the twelfth transistor M12 are turned off, no driving current is output from the driving current supply circuit 10. Meanwhile, since the seventh transistor M7 is turned off, the first operation voltage terminal is electrically decoupled from the third node N3.

In the second stage t2, the reset signal provided by the reset signal line Reset is at a low level, the gate scan signal provided by the gate line Gate is at a high level, and the control signal provided by the control signal line SW is at a low level. In such case, the third transistor M3, the ninth transistor M9, and the tenth transistor M10 are turned on, and the first transistor M1, the second transistor M2, the fourth to seventh transistors M4 to M7, the eighth transistor M8, the eleventh transistor M11, and the twelfth transistor M12 are turned off. The first data voltage provided by the first data line Data_T is written into the second node N2 through the third transistor M3, the second data voltage provided by the second data line Data_I is written into the sixth node N6 through the ninth transistor M9, the fifth node N5 is discharged through the tenth transistor M10 and the driving transistor DTFT, and when the voltage at the fifth node N5 drops to $Vdata_{_I}+Vth_{_DTFT}$, the driving transistor DTFT is turned off, and the discharge is ended; where $Vdata_{_I}$ is the second data voltage and $Vth_{_DTFT}$ is the threshold voltage of the driving transistor DTFT. Since the eleventh transistor M11 and the twelfth transistor M12 are turned off, no driving current is output from the driving current supply circuit 10. Meanwhile, since the seventh transistor M7 is turned off, the first operation voltage terminal is electrically decoupled from the third node N3.

In the third stage t3, the reset signal provided by the reset signal line Reset is at a low level, the gate scan signal provided by the gate line Gate is at a low level, and the control signal provided by the control signal line SW is at a high level. In such case, the fourth transistor M4 to the sixth transistor M6, the eleventh transistor M11, and the twelfth transistor M12 are turned on, the first transistor M1 to the third transistor M3, and the eighth transistor M8 to the tenth transistor M10 are turned off, and the seventh transistor M7 and the driving transistor DTFT are turned on first and then switched to be turned off. The third capacitor C3 can maintain the voltage of the fifth node N5 stable at $Vdata_{_I}+Vth_{_DTFT}$ in the third stage t3.

For the driving transistor DTFT, it operates in the saturation state, and it can be obtained according to the saturation current formula that:

$$\begin{aligned} I_{_DTFT} &= K_{_DTFT} * (Vgs_{_DTFT} - Vth_{_DTFT})^2 \\ &= K_{_DTFT} * (Vdata_{_t} + Vth_{_DTFT} - Vdd - Vth_{_DTFT})^2 \\ &= K_{_DTFT} * (Vdata_{_t} - Vdd)^2 \end{aligned},$$

where $I_{_DTFT}$ is the current outputted by the driving transistor DTFT in the saturation state, $Vgs_{_DTFT}$ is the gate-source voltage of the driving transistor DTFT, $K_{_M6}$ is a constant and is determined by the electrical characteristics of the sixth transistor M6. Therefore, under the condition that the first operation voltage Vdd is constant, the driving current output by the driving transistor DTFT is only related to the second data voltage $Vdata_{_I}$ and is not related to the threshold voltage $Vth_{_DTFT}$ of the driving transistor DTFT, so that the influence of nonuniform and drift of threshold voltage of the driving transistor DTFT on the driving current output by the driving transistor DTFT can be avoided, and the uniformity of the driving current output by the driving transistor DTFT is effectively improved.

Since the twelfth transistor M12 is turned on, the driving current can be supplied to the element to be driven through the signal supply terminal Input and the seventh transistor M7, so as to drive the element to be driven to operate. Since the seventh transistor M7 is switched from being turned on to being turned off in the third stage t3 (see the description in the forgoing embodiment for details), when the seventh transistor M7 is switched to being turned off, the driving transistor DTFT is electrically decoupled from the second operation voltage terminal, and the driving transistor DTFT is also switched to being turned off.

It should be noted that, the operation process of the pixel circuit with all the transistors being P-type transistors is the same as the operation process of the pixel circuit with all the transistors being N-type transistors, which is not described herein again.

Those ordinary skilled in the art should understand that the driving current supply circuit in the present embodiment may adopt other circuit structures, which are not described here by way of example.

Figure 7:
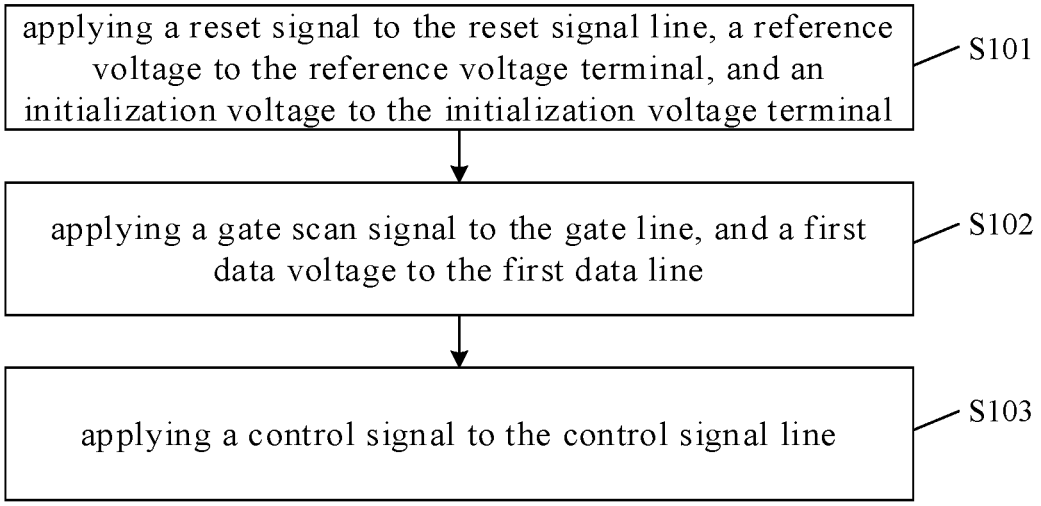
FIG. 7 is a flowchart of a driving method of a pixel circuit according to an embodiment of the present disclosure.

FIG. 7 is a flowchart of a driving method of a pixel circuit according to an embodiment of the present disclosure, and as shown in FIG. 7, the pixel circuit is the pixel circuit according to any one of the above embodiments, and the driving method includes following steps S101 to S103.

Step S101, applying a reset signal to the reset signal line, a reference voltage to the reference voltage terminal, and an initialization voltage to the initialization voltage terminal, so that the first resetting sub-circuit writes the reference voltage and the initialization voltage to the first node and the second node, respectively, in response to control of the reset signal.

Step S102, applying a gate scan signal to the gate line, and a first data voltage to the first data line, so that the first data writing sub-circuit writes the first data voltage to the second node in response to control of the gate scan signal.

Step S103, applying a control signal to the control signal line, so that the first output control sub-circuit forms an electrical path between the charging and discharging sub-circuit and the charging and discharging terminal in response to the control of the control signal, and provide the voltage at the first node to the switch sub-circuit, the charging and discharging sub-circuit perform charging process or discharging process on the first node in response to the control of the first data voltage, and the switch sub-circuit controls electrical coupling and decoupling between the signal supply terminal and the element to be driven in response to the control of the voltage at the first node.

For the specific description of the above steps S101 to S103, reference may be made to corresponding contents in the forgoing embodiments, which are not described herein again.

Figure 8:
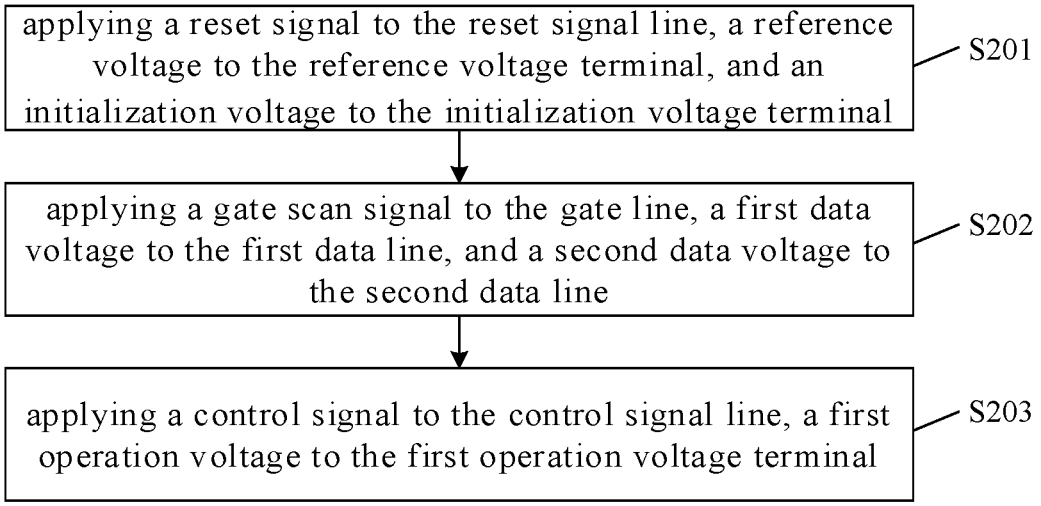
FIG. 8 is a flowchart of another driving method of a pixel circuit according to an embodiment of the present disclosure.

FIG. 8 is a flowchart of another driving method of a pixel circuit according to an embodiment of the present disclosure, and as shown in FIG. 8, the pixel circuit includes the driving current supply circuit in addition to the first resetting sub-circuit, the first data writing sub-circuit, the charging and discharging sub-circuit, the first output control sub-circuit, and the switch sub-circuit, where the driving current supply circuit includes: the second resetting sub-circuit, the second data writing sub-circuit, the threshold compensation sub-circuit, the second output control sub-circuit, and the driving transistor. The driving method of the pixel circuit includes the following steps S201 to S203.

Step S201, applying a reset signal to the reset signal line, a reference voltage to the reference voltage terminal, and an initialization voltage to the initialization voltage terminal, so that the first resetting sub-circuit writes the reference voltage and the initialization voltage to the first node and the second node, respectively, in response to control of the reset signal, and the second resetting sub-circuit writes the reference voltage to the fifth node in response to control of the reset signal.

Step S202, applying a gate scan signal to the gate line, a first data voltage to the first data line, and a second data voltage to the second data line, so that the first data writing sub-circuit writes the first data voltage to the second node in response to control of the gate scan signal, the second data writing sub-circuit writes the second data voltage to the sixth node, and the threshold compensation sub-circuit compensates for the threshold voltage of the driving transistor in response to the control of the gate line.

Step S203, applying a control signal to the control signal line, a first operation voltage to the first operation voltage terminal, so that the second output control sub-circuit writes the first operation voltage to the sixth node in response to the control of the control signal, and provides the driving current output by the driving transistor to the signal supply terminal, the first output control sub-circuit forms an electrical path between the charging and discharging sub-circuit and the charging and discharging terminal in response to the control of the control signal and provides the voltage at the first node to the switch sub-circuit, the charging and discharging sub-circuit performs charging process or discharging process on the first node in response to the control of the first data voltage, and the switch sub-circuit controls electrical coupling and decoupling between the signal supply terminal and the element to be driven in response to the control of the voltage at the first node.

For the specific description of the above steps S201 to S203, reference may be made to corresponding contents in the forgoing embodiments, which are not described herein again.

Figure 9:
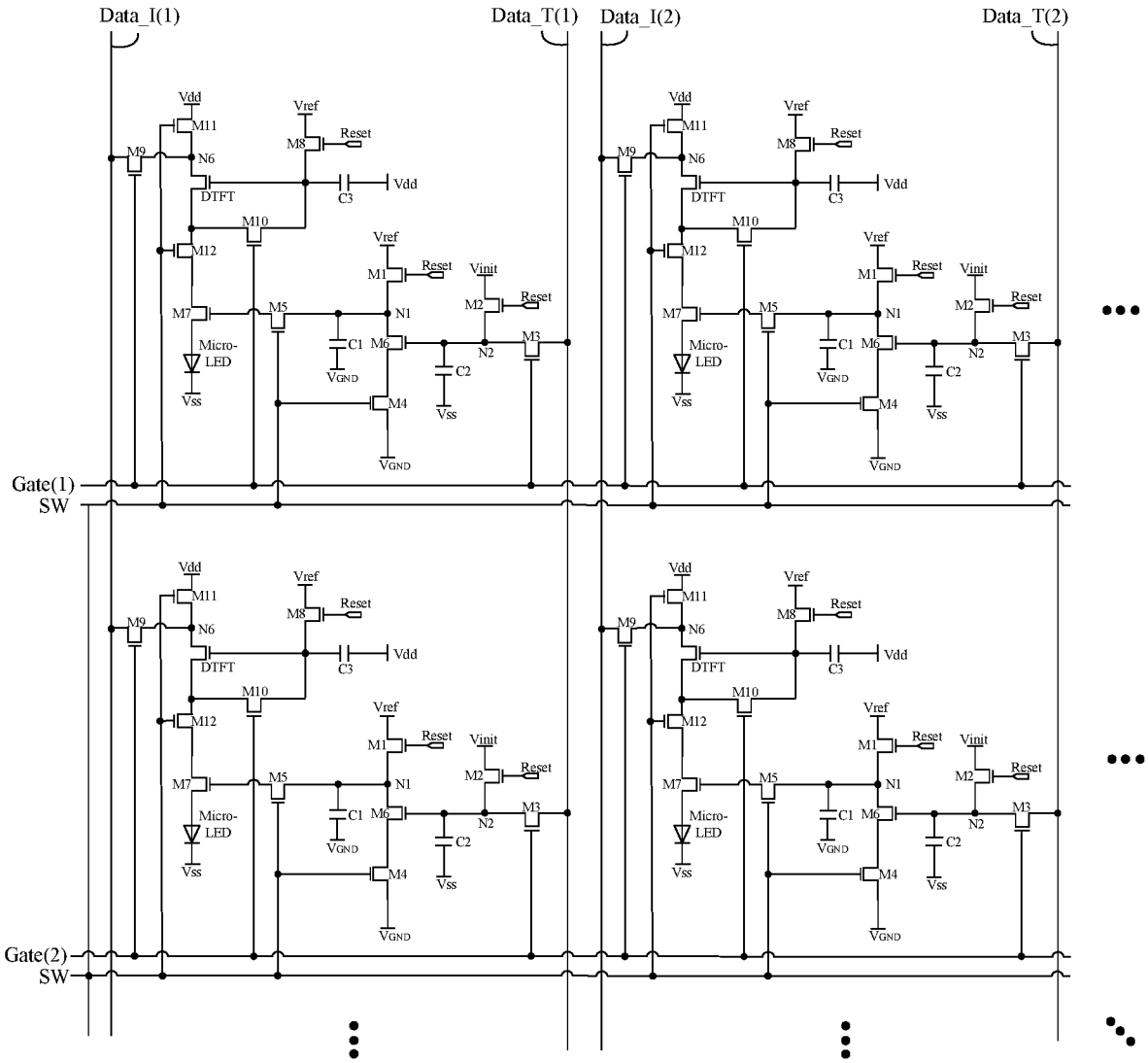
FIG. 9 is a schematic circuit diagram of a display device according to an embodiment of the present disclosure.

FIG. 9 is a schematic circuit diagram of a display device according to an embodiment of the present disclosure, and as shown in FIG. 9, the display device includes a display substrate, which includes a plurality of sub-pixels, at least one of the sub-pixels is provided with the pixel circuit provided by the forgoing embodiments and an element to be driven, and the pixel circuit is used for providing a driving signal for the element to be driven.

In some implementations, the element to be driven includes: an LED or a Micro-LED.

In some implementations, the number of the sub-pixels is greater than or equal to 2, it should be noted that, 2×2 sub-pixels are exemplarily illustrated in FIG. 9, and each of pixel circuits in the sub-pixels adopts the pixel circuit illustrated in FIG. 5 (i.e., including the first transistor M1 to the twelfth transistor M12, the driving transistor DTFT, and the first capacitor C1 to the third capacitor C3), which is only exemplary and does not limit the technical solution of the present disclosure.

In some implementations, in a pixel array formed by a plurality of sub-pixels, the sub-pixels in a same row correspond to a same gate line Gate (1)/Gate (2), the sub-pixels in a same column correspond to a same first data line Data_T (1)/Data_T (2) and a same second data line Data_I (1)/Data_I (2), and all the sub-pixels correspond to a same control signal line SW. It should be noted that, the above cases are only exemplary, and do not limit the technical solution of the present disclosure.

The display device provided by the embodiment of the present disclosure may be any product or component with a display function, such as electronic paper, an LED panel, a mobile phone, a tablet computer, a television, a display, a notebook computer, a digital photo frame, and a navigator.

It will be understood that the above embodiments are merely exemplary embodiments adopted to illustrate the principles of the present disclosure, but the present disclosure is not limited thereto. It will be apparent to those ordinary skilled in the art that various modifications and improvements can be made without departing from the spirit and scope of the present disclosure, and such modifications and improvements are considered to be within the scope of the present disclosure.

The invention claimed is:

1. A pixel circuit, comprising: a first resetting sub-circuit, a first data writing sub-circuit, a charging and discharging sub-circuit, a first output control sub-circuit and a switch sub-circuit, wherein the first resetting sub-circuit, the charging and discharging sub-circuit and the first output control sub-circuit are coupled to a first node, and the first resetting sub-circuit, the first data writing sub-circuit and the charging and discharging sub-circuit are coupled to a second node;

the first resetting sub-circuit is configured to write a reference voltage and an initialization voltage to the first node and the second node, respectively, in response to control of a signal of a reset signal line;

the first data writing sub-circuit is configured to write a first data voltage to the second node in response to control of a signal of a gate line;

the first output control sub-circuit is configured to form an electrical path between the charging and discharging sub-circuit and a charging and discharging terminal, and provide a voltage at the first node to the switch sub-circuit in response to control of a signal of a control signal line;

the charging and discharging sub-circuit is configured to charge or discharge the first node in response to control of the first data voltage;

the switch sub-circuit is coupled to a signal supply terminal and an element to be driven, and is configured to control, in response to control of the voltage at the first node provided by the first output control sub-circuit, electrical coupling and decoupling between the signal supply terminal and the element to be driven.

2. The pixel circuit of claim 1, wherein the first resetting sub-circuit comprises: a first transistor and a second transistor;

a control electrode of the first transistor is coupled to the reset signal line, a first electrode of the first transistor is coupled to a reference voltage terminal, and a second electrode of the first transistor is coupled to the first node;

a control electrode of the second transistor is coupled to the reset signal line, the first electrode of the second transistor is coupled to an initialization voltage terminal, and a second electrode of the second transistor is coupled to the second node.

3. The pixel circuit of claim 2, wherein the first data writing sub-circuit comprises: a third transistor;

a control electrode of the third transistor is coupled to the gate line, a first electrode of the third transistor is coupled to a first data line, and a second electrode of the third transistor is coupled to the second node.

4. The pixel circuit of claim 3, wherein the first output control sub-circuit comprises: a fourth transistor and a fifth transistor;

a control electrode of the fourth transistor is coupled to the control signal line, a first electrode of the fourth transistor is coupled to the charging and discharging sub-circuit, and a second electrode of the fourth transistor is coupled to the charging and discharging terminal; and a control electrode of the fifth transistor is coupled to the control signal line, a first electrode of the fifth transistor is coupled to the first node, and a second electrode of the fifth transistor is coupled to the switch sub-circuit.

5. The pixel circuit of claim 4, wherein the charging and discharging sub-circuit comprises: a sixth transistor and a first capacitor;

a control electrode of the sixth transistor is coupled to the second node, a first electrode of the sixth transistor is coupled to the first node, and a second electrode of the sixth transistor is coupled to the first output control sub-circuit;

a first terminal of the first capacitor is coupled to the first node, and a second terminal of the first capacitor is coupled to a first constant voltage terminal.

6. The pixel circuit of claim 5, wherein the switch sub-circuit comprises: a seventh transistor;

a control electrode of the seventh transistor is coupled to the first output control sub-circuit, a first electrode of the seventh transistor is coupled to the signal supply terminal, and a second electrode of the seventh transistor is coupled to the element to be driven.

7. The pixel circuit of claim 6, wherein the pixel circuit further comprises: a driving current supply circuit, the driving current supply circuit is coupled to the signal supply terminal, and the driving current supply circuit is configured to provide a driving current to the switch sub-circuit through the signal supply terminal;

the driving current supply circuit comprises: a second resetting sub-circuit, a second data writing sub-circuit, a threshold compensation sub-circuit, a second output control sub-circuit, and a driving transistor, wherein a second electrode of the driving transistor, the threshold compensation sub-circuit, and the second output control sub-circuit are coupled to a fourth node, a control electrode of the driving transistor, the threshold compensation sub-circuit, and the second resetting sub-circuit are coupled to a fifth node, and a first electrode of the driving transistor, the second data writing sub-circuit, and the second output control sub-circuit are coupled to a sixth node; and the second resetting sub-circuit is configured to write the reference voltage to the fifth node in response to control of the signal of the reset signal line;

the second data writing sub-circuit is configured to write a second data voltage to the sixth node in response to control of the signal of the gate line;

the threshold compensation sub-circuit is configured to compensate for a threshold voltage of the driving transistor in response to control of the signal of the gate line;

the second output control sub-circuit is configured to write a first operation voltage to the sixth node and supply the driving current output by the driving transistor to the signal supply terminal in response to control of the signal of the control signal line;

the driving transistor is configured to output the driving current under control of a voltage at the fifth node and a voltage at the sixth node;

the second resetting sub-circuit comprises: an eighth transistor, a control electrode of the eighth transistor is coupled to the reset signal line, a first electrode of the eighth transistor is coupled to the reference voltage terminal, and a second electrode of the eighth transistor is coupled to the fifth node;

the second data writing sub-circuit comprises: a ninth transistor, a control electrode of the ninth transistor is coupled to the gate line, a first electrode of the ninth transistor is coupled to a second data line, and a second electrode of the ninth transistor is coupled to the sixth node;

the threshold compensation sub-circuit comprises: a tenth transistor, a control electrode of the tenth transistor is coupled to the gate line, a first electrode of the tenth transistor is coupled to the fourth node, and a second electrode of the tenth transistor is coupled to the fifth node;

the second output control sub-circuit comprises: an eleventh transistor and a twelfth transistor, a control electrode of the eleventh transistor is coupled to the control signal line, a first electrode of the eleventh transistor is coupled to a first operation voltage terminal, and a second electrode of the eleventh transistor is coupled to the sixth node; a control electrode of the twelfth transistor is coupled to the control signal line, a first electrode of the twelfth transistor is coupled to the fourth node, and a second electrode of the twelfth transistor is coupled to the signal supply terminal; and wherein all the transistors in the pixel circuit are N-type transistors; or all the transistors in the pixel circuit are P-type transistors.

8. The pixel circuit of claim 1, further comprising: a second capacitor;

a first terminal of the second capacitor is coupled to the second node, and a second terminal of the second capacitor is coupled to a second constant voltage terminal.

9. The pixel circuit of claim 1, wherein the signal supply terminal is coupled to a first operation voltage terminal, the first operation voltage terminal providing a first operation voltage to the switch sub-circuit via the signal supply terminal.

10. The pixel circuit of claim 1, further comprising: a driving current supply circuit, wherein the driving current supply circuit is coupled to the signal supply terminal, and the driving current supply circuit is configured to provide a driving current to the switch sub-circuit through the signal supply terminal.

11. The pixel circuit of claim 10, wherein the driving current supply circuit comprises: a second resetting sub-circuit, a second data writing sub-circuit, a threshold compensation sub-circuit, a second output control sub-circuit, and a driving transistor, wherein a second electrode of the driving transistor, the threshold compensation sub-circuit, and the second output control sub-circuit are coupled to a fourth node, a control electrode of the driving transistor, the threshold compensation sub-circuit, and the second resetting sub-circuit are coupled to a fifth node, and a first electrode of the driving transistor, the second data writing sub-circuit, and the second output control sub-circuit are coupled to a sixth node; and the second resetting sub-circuit is configured to write the reference voltage to the fifth node in response to control of the signal of the reset signal line;

the second data writing sub-circuit is configured to write a second data voltage to the sixth node in response to control of the signal of the gate line;

the threshold compensation sub-circuit is configured to compensate for a threshold voltage of the driving transistor in response to control of the signal of the gate line;

the second output control sub-circuit is configured to write a first operation voltage to the sixth node and supply the driving current output by the driving transistor to the signal supply terminal in response to control of the signal of the control signal line;

the driving transistor is configured to output the driving current under control of a voltage at the fifth node and a voltage at the sixth node.

12. The pixel circuit of claim 11, wherein the second resetting sub-circuit comprises: an eighth transistor, and a control electrode of the eighth transistor is coupled to the reset signal line, a first electrode of the eighth transistor is coupled to the reference voltage terminal, and a second electrode of the eighth transistor is coupled to the fifth node.

13. The pixel circuit of claim 11, wherein the second data writing sub-circuit comprises: a ninth transistor, and a control electrode of the ninth transistor is coupled to the gate line, a first electrode of the ninth transistor is coupled to a second data line, and a second electrode of the ninth transistor is coupled to the sixth node.

14. The pixel circuit of claim 11, wherein the threshold compensation sub-circuit comprises: a tenth transistor, and a control electrode of the tenth transistor is coupled to the gate line, a first electrode of the tenth transistor is coupled to the fourth node, and a second electrode of the tenth transistor is coupled to the fifth node.

15. The pixel circuit of claim 11, wherein the second output control sub-circuit comprises: an eleventh transistor and a twelfth transistor, and a control electrode of the eleventh transistor is coupled to the control signal line, a first electrode of the eleventh transistor is coupled to a first operation voltage terminal, and a second electrode of the eleventh transistor is coupled to the sixth node;

a control electrode of the twelfth transistor is coupled to the control signal line, a first electrode of the twelfth transistor is coupled to the fourth node, and a second electrode of the twelfth transistor is coupled to the signal supply terminal.

16. The pixel circuit of claim 11, further comprising: a third capacitor, and a first terminal of the third capacitor is coupled to the fifth node, and a second terminal of the third capacitor is coupled to a third constant voltage terminal.

17. A display device, comprising: a display substrate comprising a plurality of sub-pixels, at least one of the sub-pixels is provided with the pixel circuit of claim 1 and an element to be driven, the pixel circuit being configured to provide a driving signal to the element to be driven.

18. The display device of claim 17, wherein the element to be driven comprises an LED or a Micro-LED.

19. A driving method for driving the pixel circuit of claim 1, the driving method comprising:

applying a reset signal to the reset signal line, the reference voltage to a reference voltage terminal, and the initialization voltage to the initialization voltage terminal, so that the first resetting sub-circuit writes the reference voltage and the initialization voltage to the first node and the second node, respectively, in response to control of the reset signal;

applying a gate scan signal to the gate line, applying the first data voltage to a first data line, so that the first data writing sub-circuit writes the first data voltage to the second node in response to control of the gate scan signal; and applying a control signal to the control signal line so that the first output control sub-circuit forms an electrical path between the charging and discharging sub-circuit and a charging and discharging terminal in response to control of the control signal, and provides the voltage at the first node to the switch sub-circuit, the charging and discharging sub-circuit charges or discharges the first node in response to control of the first data voltage, and the switch sub-circuit controls electrical coupling and decoupling between the signal supply terminal and the element to be driven in response to control of the voltage at the first node.

20. The driving method of claim 19, wherein the pixel circuit comprises a driving current supply circuit comprising: a second resetting sub-circuit, a second data writing sub-circuit, a threshold compensation sub-circuit, a second output control sub-circuit, and a driving transistor; and the second resetting sub-circuit writes the reference voltage to the fifth node in response to control of the reset signal when the reset signal is applied to the reset signal line and the reference voltage is applied to the reference voltage terminal;

while applying the gate scan signal to the gate line, applying a second data voltage to a second data line to cause the second data writing sub-circuit to write the second data voltage to the sixth node, the threshold compensation sub-circuit compensates for the threshold voltage of the driving transistor in response to control of the gate line;

while applying the control signal to the control signal line, applying the first operation voltage to the first operation voltage terminal, so that the second output control sub-circuit writes the first operation voltage to the sixth node in response to control of the control signal, and supplies the driving current output by the driving transistor to the signal supply terminal.

* * * * *